US006422886B1

(12) United States Patent
Macbeth et al.

(10) Patent No.: US 6,422,886 B1
(45) Date of Patent: Jul. 23, 2002

(54) METHOD AND APPARATUS FOR ALIGNING AND ELECTRICALLY CONNECTING MATING CONNECTORS

(75) Inventors: Christopher S. Macbeth, Loveland; Andrew S. Poulsen, Fort Collins; Donald Kedrowski, Loveland, all of CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/699,166

(22) Filed: Oct. 27, 2000

(51) Int. Cl.[7] ..... H01R 13/64
(52) U.S. Cl. ..... 439/247; 439/248
(58) Field of Search ..... 439/247, 248, 439/378, 188, 289

(56) References Cited

U.S. PATENT DOCUMENTS 6,224,407 B1 * 5/2001 Duquerroy et al. ..... 439/188

* cited by examiner

*Primary Examiner*—Tho D. Ta
*Assistant Examiner*—Phuong Nguyen

(57) ABSTRACT

Connector alignment apparatus may include a mounting plate and a first connector sized to engage a mating connector on a device under test. A connector biasing device is operatively associated with the mounting plate and the first connector. The connector biasing device allows the first connector to move with respect to the mounting plate as the first connector is engaged with the mating connector.

12 Claims, 7 Drawing Sheets

METHOD AND APPARATUS FOR ALIGNING AND ELECTRICALLY CONNECTING MATING CONNECTORS

FIELD OF THE INVENTION

This invention relates to test equipment for testing printed circuit boards and other electrical devices in general and more specifically to a method and apparatus for aligning and electrically connecting a first connector portion with a mating connector portion contained on a printed circuit board.

BACKGROUND

Printed circuit boards are well-known in the art and are used in various types of electronic devices. The common applications for printed circuit boards and the types of electronic devices in which they are used are far too numerous to list herein.

The typical printed circuit board is provided with a plurality of electrical components mounted thereon and is typically referred to as a "loaded" printed circuit board or, simply, a loaded board. Before the loaded printed circuit board is passed on to the end-user or final application, it is usually tested to verify that all required electrical connections have been properly completed and to ensure that all of the components contained thereon are functional. In addition, some electrical components and electromechanical components may also require adjustment.

A variety of test equipment have heretofore been available for testing loaded printed circuit boards. For example, one type of tester is a so-called "bed of nails" tester which is designed to simultaneously contact a plurality of circuit nodes on the board. While such bed of nails testers are effective in testing the functionality of loaded printed circuit boards, some types of printed circuit boards, such as those used in cellular telephones, may include one or more electrical connectors or receptacles thereon that are sized to engage mating connector portions associated with other electronic components or systems that are to be connected to the loaded circuit board. Unfortunately, however, the functionality of such electrical connectors cannot be ascertained with conventional testers (e.g., bed of nails testers). Consequently, the electrical connectors provided on such printed circuit boards are tested by manually connecting a mating connector portion with the electrical connector provided on the printed circuit board.

Although such a manual procedure may be effective from a functional standpoint, such a manual procedure is not without its problems. For example, the technician performing the test may damage the connectors by applying an excessive force or by trying to force a connection between misaligned connectors. To ensure that the connectors are aligned properly and that the proper amount of force is applied, the technician must exercise great care and patience. Thus, manually aligning and connecting mating connectors requires a significant amount of time.

Although an automated procedure would appear to be the likely solution, mating connectors of the type commonly used on printed circuit boards do not readily lend themselves to a procedure in which they are aligned and connected without any manual intervention. More specifically, mating connectors provide only a minimal amount of misalignment tolerance which poses a large obstacle for an automated procedure. Even if an automated process were feasible, the connectors would likely suffer external damage due to side strikes, a frequent occurrence on automated factory lines.

The solder joint securing the connector to the printed circuit board may also be damaged during an automated procedure since the existing design of mating connectors allows the forces needed to disengage the mating connectors to be transferred to the solder joint. Finally, unless the automated procedure can be quickly adapted to any of the other various well-known types of connectors, its usefulness would be severely limited.

Consequently, a need remains for connector alignment apparatus that aligns and electrically connects mating connectors without any manual intervention. The connector alignment apparatus should axially align the mating connectors prior to and after their engagement and accommodate some initial misalignment without causing any damage to the connectors. The connector alignment apparatus should electrically connect the mating connectors with only a minimal amount of force. Ideally, the connector alignment apparatus would protect the connectors from side strikes and minimize the stresses placed on the solder joint during the engagement and disengagement processes. Finally, the connector alignment apparatus should allow a technician to easily and quickly adapt the connector alignment apparatus for use with other types of connectors.

SUMMARY OF THE INVENTION

Connector alignment apparatus may comprise a mounting plate and a first connector sized to engage a mating connector provided on a device under test. A connector biasing device operatively associated with the mounting plate and the first connector allows the first connector to move with respect to the mounting plate as the first connector is engaged with the mating connector.

Also disclosed is a method for aligning and electrically connecting a first connector and a mating connector that comprises the steps of: Floatingly mounting the first connector to a mounting plate; providing a connector biasing device operatively associated with the mounting plate and the first connector that allows the first connector to move with respect to the mounting plate as the first connector is engaged with the mating connector; and causing the first connector to engage the mating connector.

BRIEF DESCRIPTION OF THE DRAWING

Illustrative and presently preferred embodiments of the invention are shown in the accompanying drawing in which.

DETAILED DESCRIPTION OF THE INVENTION

Figure 1:
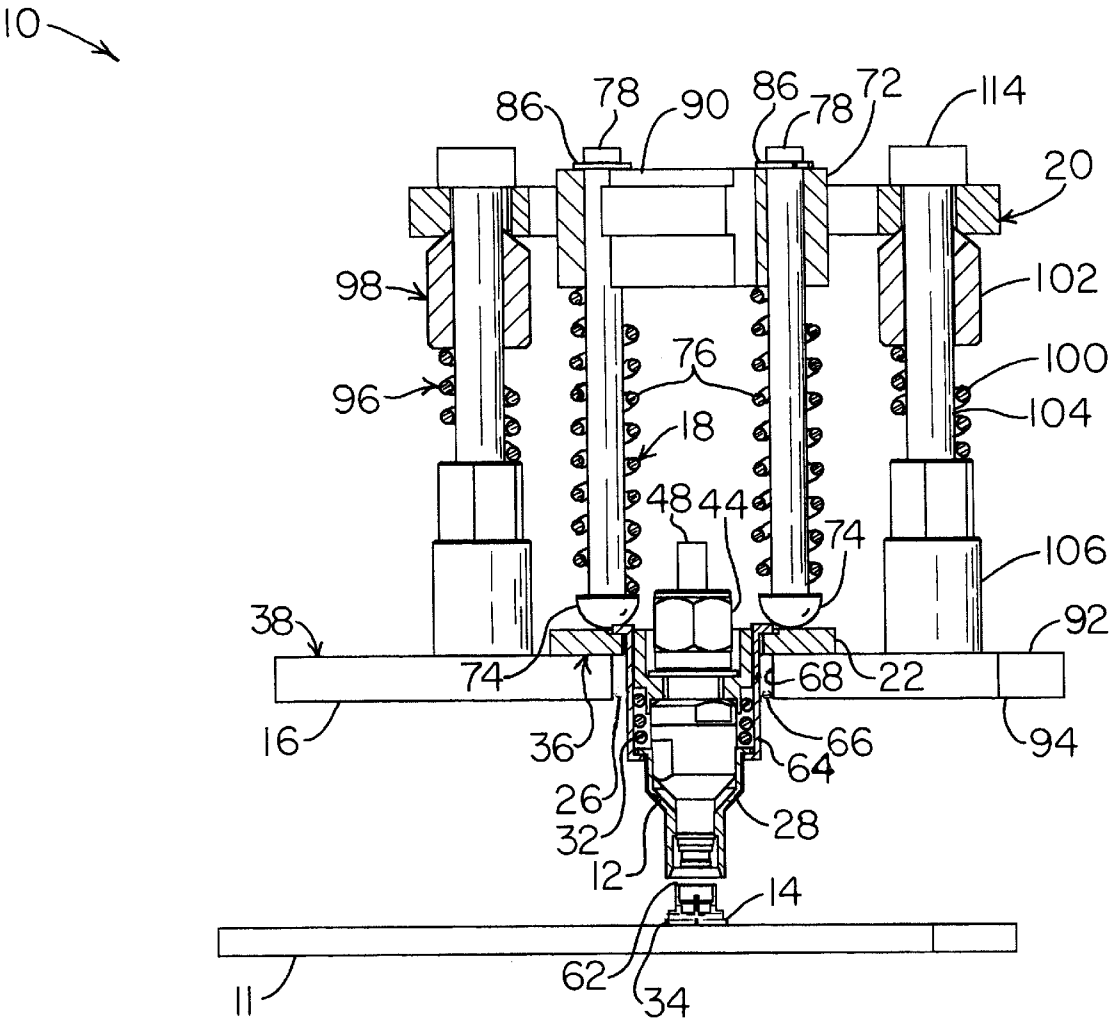
FIG. 1 is a cross-sectional view in elevation of the connector alignment apparatus according to one embodiment of the present invention.

Connector alignment apparatus 10 according to one preferred embodiment of the present invention is shown in FIG.

1 and described herein as it could be used to align and electrically connect a first connector 12 and a mating connector 14 mounted on a device under test, e.g., a printed circuit board 11. In the embodiment shown and described herein, the first connector 12 and the mating connector 14 comprise SMA type connectors. Alternatively, and as will be explained in greater detail below, the connector alignment apparatus 10 may be used in conjunction with any of a wide range of other connector types now known in the art or that may be developed in the future.

The connector alignment apparatus 10 may comprise a mounting plate 16 and a connector biasing device 18 (i.e., a tripod spring assembly 20) that allows the first connector 12 to move or "float" with respect to the mounting plate 16. This moving or "floating" mounting arrangement allows the first connector 12 to move slightly as the two connectors 12 and 14 are brought together, thereby assisting in the full engagement of the connectors 12 and 14 even though they may be slightly misaligned.

The first connector 12 is mounted to an alignment disk or member 22 that has a lower portion 24 that is sized to be "floatingly" (i.e., loosely) received within an aperture 26 defined by mounting plate 16. In other words, aperture 26 is slightly larger than the lower portion 24 of alignment member 22. Actually, in the embodiment shown and described herein, it is the spring sleeve 64, which fits over the lower portion 24 of alignment member 22, that is directly floatingly received within the aperture 26 in mounting plate 16. However, the lower portion 24 of alignment member 22 is indirectly floatingly received within the aperture 26. See FIG. 1. The connector biasing device 18 allows the alignment member 22 and the first connector 12 to translate in the x and y directions 13 and 15 (FIG. 3) with respect to the mounting plate 16. As will be discussed in greater detail below, the connector biasing device 18 also allows the alignment member 22 and the first connector 12 to translate in the z direction 17 once the connectors 12 and 14 are fully engaged. The mounting arrangement also allows the first connector 12 to tilt slightly (i.e., to rotate slightly about the x and y axes 13 and 15) to accommodate a slight misalignment between the connector alignment apparatus 10 and the printed circuit board 11.

The connector alignment apparatus 10 also may be provided with an alignment sleeve 28 that is sized to fit over or engage the outer surface 62 of the mating connector 14. The alignment sleeve 28 is slidably mounted over a lower external portion 30 of the first connector 12 so that the alignment sleeve 28 can move with respect to the first connector 12 between an extended position (illustrated in FIGS. 1, 2, and 7) and a retracted position (illustrated in FIG. 4). A sleeve spring 32 biases the alignment sleeve 28 toward the extended position.

The connector alignment apparatus 10 also may be provided with an alignment sleeve 28 that is sized to fit over or engage the outer surface 62 of the mating connector 14. The alignment sleeve 28 is slidably mounted over a lower external portion 30 of the first connector 12 so that the alignment sleeve 28 can move with respect to the first connector 12 between an extended position (illustrated in FIGS. 1, 2, and 7) and a retracted position (illustrated in FIG. 4). A sleeve biasing device or sleeve spring 32 biases the alignment sleeve 28 toward the extended position.

Once the testing is complete, the printed circuit board 11 is lowered. As the printed circuit board 11 is lowered, the downward spring bias of alignment sleeve 28 assists in the disengagement of the connectors 12 and 14. Continued lowering of the printed circuit board 11 causes the connector biasing device 18 to decompress until the alignment member 22 returns to the initial position. The printed circuit board 11 may then be transported away and the next printed circuit board (not shown) tested.

A significant advantage of the present invention is that it aligns and electrically connects the mating connectors 12 and 14 without the need for any manual intervention. Thus, the connector alignment apparatus 10 allows for an automated test procedure. Another significant advantage of the present invention is that the connector alignment apparatus 10 axially aligns the mating connectors 12 and 14 prior to and after their engagement and accommodates some initial misalignment of the connectors 12 and 14 without causing any damage thereto. The connector alignment apparatus 10 is able to align and electrically connect the mating connectors 12 and 14 with only a minimal amount of force.

Yet another significant advantage of the present invention is that the connector alignment apparatus 10 is self-extracting. As is discussed briefly above and in much greater detail below, the downward bias of the alignment sleeve 28 presses against the mating connector 14 (not the printed circuit board 11) when the printed circuit board 11 is moved away from the connector alignment apparatus 10. Accordingly, the forces needed to disengage the connectors 12 and 14 are localized to the connectors 12 and 14, thereby minimizing the stresses on the solder joint 34 that secures the mating connector 14 to the printed circuit board 11.

Still yet another significant advantage of the present invention is that the alignment sleeve 28 protects the connectors 12 and 14 from external damage that could arise due to side strikes, a frequent occurrence on automated factory lines. Since the alignment sleeve 28 is sized to extend over the mating connector 14 and the lower portion 30 of first connector 12, the alignment sleeve 28 prevents side strike forces from causing damage to the connectors 12, 14. The alignment sleeve 28 absorbs the forces caused by side strikes and transfers those forces to the connector alignment apparatus 10.

A further advantage of the present invention is that the connector alignment apparatus 10 can be quickly adapted for use with other types of connectors. Moreover, since the connector alignment apparatus 10 can be assembled and disassembled without tools, the process of assembling the overall test system is greatly simplified. Indeed, installing or removing the connector alignment apparatus 10 (i.e., for connector replacement or calibration) requires no tools and very little hand effort from the technician.

Having briefly described the connector alignment apparatus 10 according to one embodiment of the present invention, as well as some of its more significant features and advantages, the various preferred embodiments of the connector alignment apparatus will now be described in detail. However, before proceeding with the description, it should be noted that while the connector alignment apparatus 10 is shown and described herein as it could be used to align and electrically connect a SMA-Female to SMP-Female adapter (i.e., the first connector 12) and a SMA-Male connector (i.e., the mating connector 14), it could also be used in conjunction with any of wide range of other types of connectors and adapters associated with various other electronic devices. Consequently, the present invention should not be regarded as limited to use in conjunction with the particular connector types shown and described herein.

Figure 2:
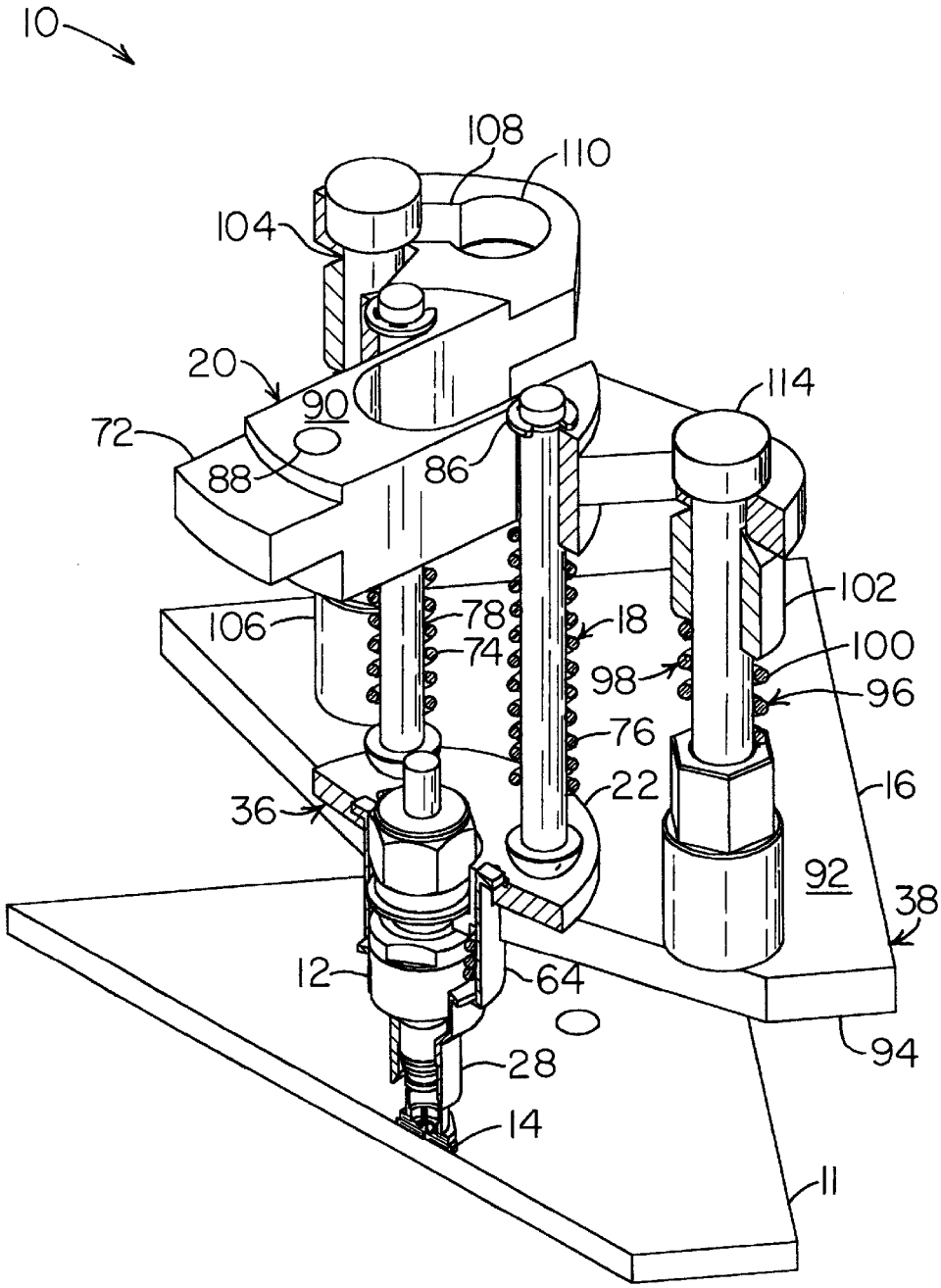
FIG. 2 is cross-sectional perspective view of the connector alignment apparatus illustrated in FIG. 1.

With the foregoing considerations in mind, one preferred embodiment of the connector alignment apparatus 10 according to the present invention is shown in FIG. 1 and is described herein as it could be used to align and electrically connect a first connector 12 (e.g., a SMA-Female to SMP-Female adapter) and a mating connector 14 (e.g. a SMA-Male connector). In the embodiment shown and described herein, the SMA-Male connector (i.e., the mating connector 14) is mounted to the printed circuit board 11, although this need not be the case. That is, the mating connector 14 could comprise a female type SMA connector. In any event, since SMA-Male connectors and SMA-Female to SMP-Female adapters are well-known in the art and need not be described in detail in order to understand the present invention, the various component parts of the SMA-Female to SMP-Female adapter 12 and SMA-Male connector 14 will not be discussed in further detail herein.

The connector alignment apparatus 10 may comprise three major assemblies: A tripod spring assembly 20, a connector assembly 36, and a mounting assembly 38. For ease of presentation, the connector assembly 36 will be described first, followed by the tripod spring assembly 20 and the mounting assembly 38.

The connector assembly 36 is best seen in FIGS. 1, 2, 6 and 7 and may comprise an alignment disk or member 22 having a cylindrically shaped lower portion 24 that is sized to floatingly (i.e., loosely) fit within the aperture 26 defined by mounting plate 16. As was briefly mentioned above, the spring sleeve 64, which fits over the lower portion 24 of alignment member 22, is directly floatingly received within the aperture 26 in the mounting plate 16. However, the lower portion 24 of alignment member 22, which receives the spring sleeve 64, is also (albeit indirectly) floatingly received within the aperture 26, as is best seen FIG. 1. The arrangement is such that the alignment member 22 and the first connector 12 are free to translate in the x and y directions 13 and 15 (FIG. 3) with respect to the mounting plate 16. The connector biasing device 18 also allows the alignment member 22 and the first connector 12 to translate in the z direction 17 once the connectors 12 and 14 are engaged. See FIG. 4. The mounting arrangement also allows the first connector 12 to tilt slightly (i.e., to rotate slightly about the x and y axes 13 and 15) to accommodate slight misalignment between the connector alignment apparatus 10 and the printed circuit board 11.

The alignment member 22 defines a central opening 40 therein that is sized to receive an upper portion 42 of the first connector 12 (e.g., a SMP Cable Nut 44). See FIGS. 6 and 7. In the embodiment shown herein, the first connector 12 is connected to the tester (not shown) by way of a cable 48, although other connection methods are possible. It is generally preferred, but not required, that the SMP cable nut 44 and a wave washer 46 be used to mount the first connector 12 to the alignment member 22, although other configurations are possible. The alignment member 22 may also define two openings 50 therein, each of which may comprise a notch 52 sized to allow an ear 54 of a sleeve spring captivator 64 to be passed therethrough. Alignment member 22 may also be provided with a pair of pockets or recessed areas 56 sized to receive therein the ears 54 of sleeve spring captivator 64. See FIGS. 6 and 7.

The alignment member 22 may be fabricated from any of a wide range of materials (such as metals or plastics) that would be suitable for the intended application. In one preferred embodiment, the alignment member 22 is fabricated from aluminum.

Figure 4:
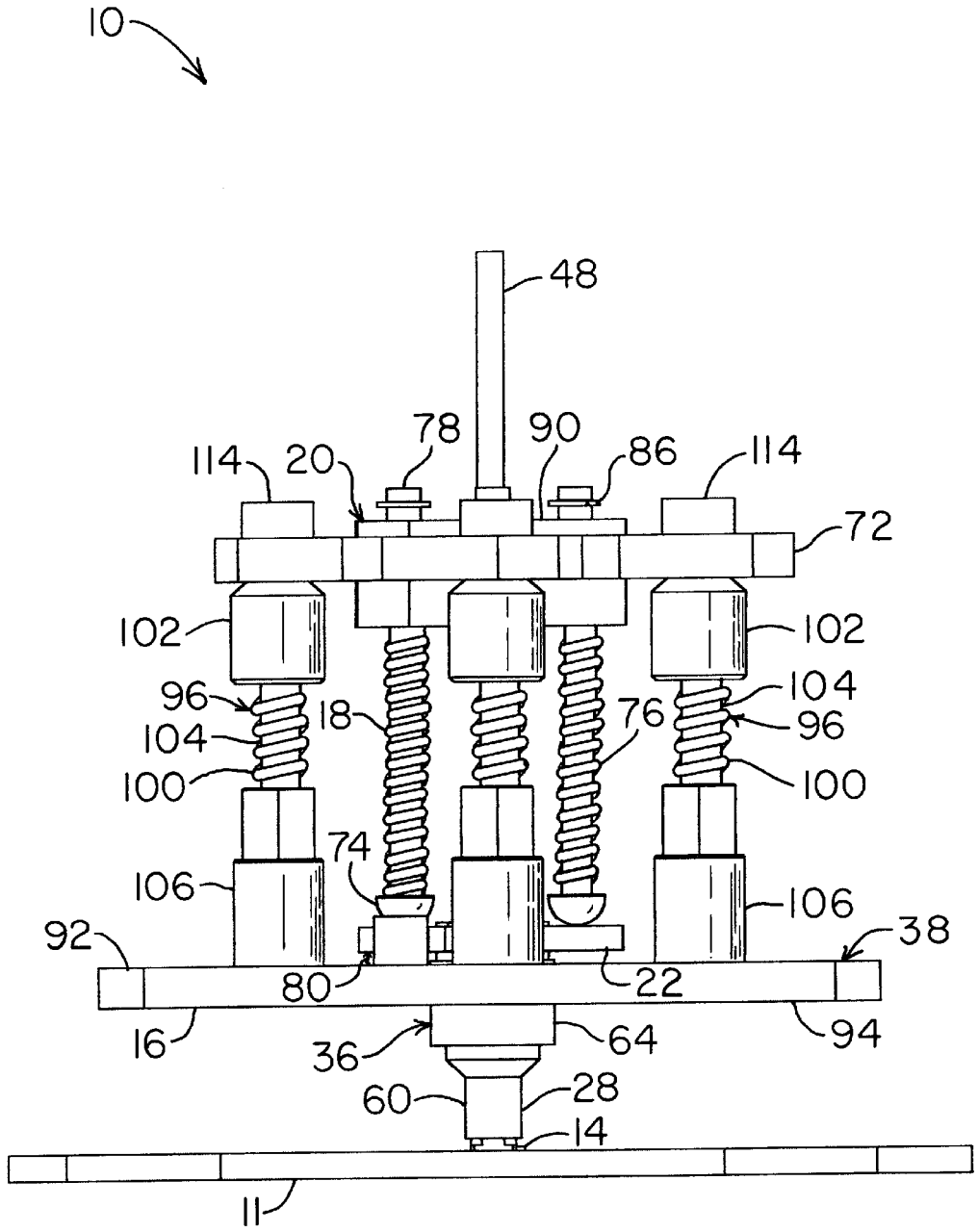
FIG. 4 is an elevational view of the connector alignment apparatus shown engaged with the mating connector on the device under test.
Figure 7:
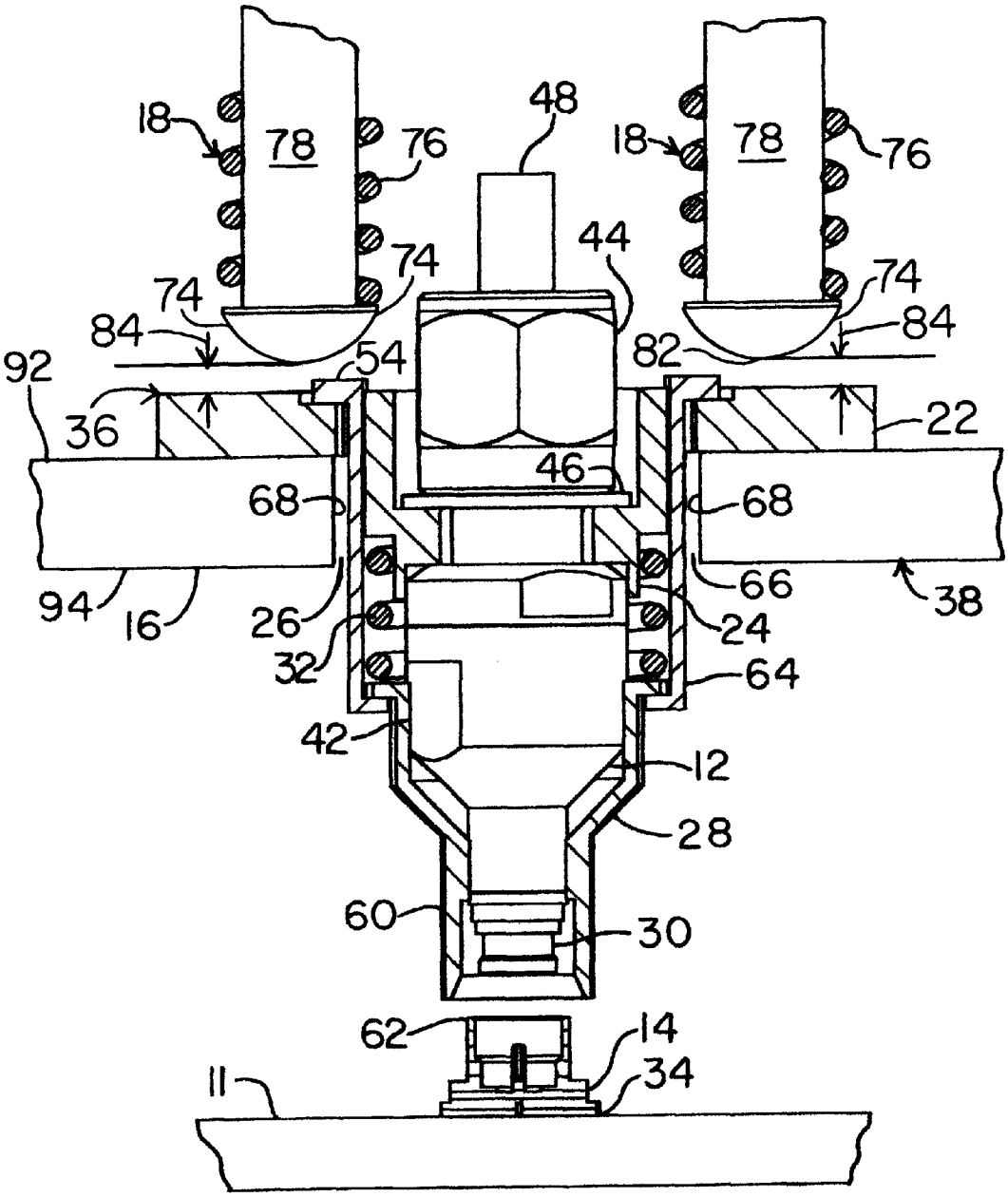
FIG. 7 is an enlarged cross-sectional view of the connector assembly.

The connector assembly 36 may also be provided with an alignment sleeve 28 having a central opening 58 defined therein. The central opening 58 may be sized to receive the first connector 12. More specifically, in the embodiment shown and described herein, the central opening 58 of alignment sleeve 28 is sized to receive a lower portion 30 of first connector 12. The central opening 58 of alignment sleeve 28 is also provided with a lower portion 60 that is sized to fit over an outer cylindrical surface 62 provided on mating connector 14, as best seen in FIGS. 4 and 7. The alignment sleeve 28 may be fabricated from any of a wide range of materials (such as metals or plastics) that would be suitable for the intended application. In one preferred embodiment, the alignment sleeve 28 is fabricated from stainless steel.

Figure 6:
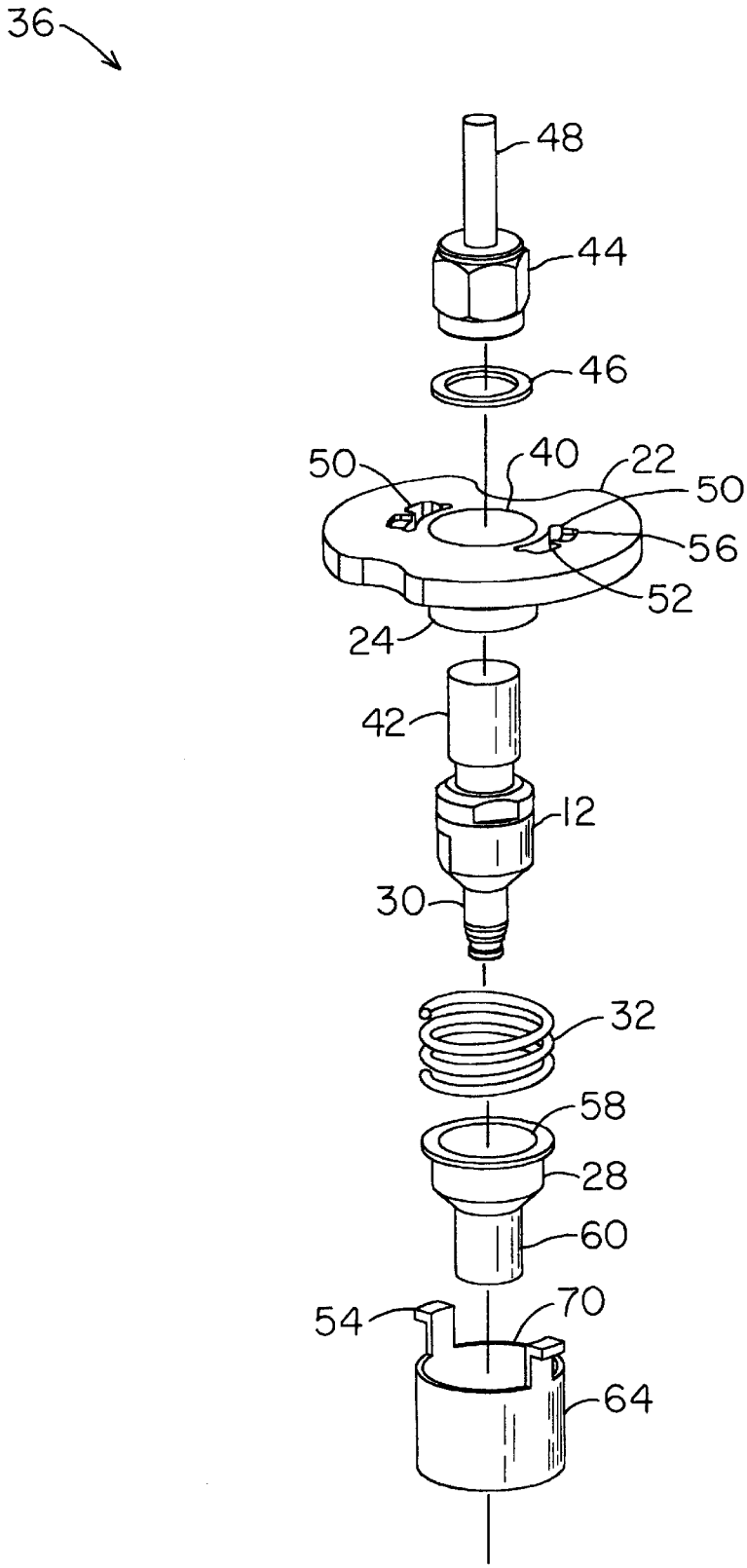
FIG. 6 is an exploded perspective view of the connector assembly.

The connector assembly 36 may also be provided with a sleeve biasing device or sleeve spring 32 positioned between the alignment sleeve 28 and alignment member 22, as best seen in FIGS. 6 and 7. The sleeve spring 32 biases the alignment sleeve 22 downward with respect to the first connector 12. The downward bias of the alignment sleeve 28 assists in the disengagement of the connectors 12 and 14. That is, the sleeve spring 32 causes the lower portion 60 of alignment sleeve 28 to press against the mating connector 14. In the embodiment shown and described herein, the sleeve spring 32 comprises a coil spring. Alternatively, other types of biasing devices could be used, as would be obvious to persons having ordinary skill in the art after having become familiar with the teachings of the present invention.

The sleeve spring captivator 64 is best seen in FIGS. 6 and 7 and comprises a generally cylindrically shaped structure defining a central opening 70 therein. The central opening 70 is sized to receive the sleeve spring 32 and to allow the alignment sleeve 28 to be retracted into the sleeve spring captivator 64. The sleeve spring captivator 64 prevents the alignment sleeve 28 from being extended beyond the initial position illustrated in FIG. 7. However, the sleeve spring captivator 64 will allow the alignment sleeve 28 to move upward (i.e., in the z-direction 17) during the engagement process.

The sleeve spring captivator 64 is also sized so that a diametrical clearance 66 is defined between the sleeve spring captivator 64 and a surface 68 that defines aperture 26 in the alignment member 22. The diametrical clearance 66 allows the connector assembly 36 to move or "float" with respect to the mounting plate 16 thereby accommodating for some initial misalignment of the connectors 12 and 14. In the embodiment shown and described herein, the diametrical clearance 66 is approximately 0.75 millimeters, although other clearances are possible.

The sleeve spring captivator 64 may be mounted to the alignment member 22 via openings 50 provided in the alignment member 22 (FIG. 6). Once the ears 54 are passed through the notches 52, the sleeve spring captivator 64 is rotated to engage the ears 54 with the recessed areas 56 provided on the alignment member 22.

The sleeve spring captivator 64 may be fabricated from any of a wide range of suitable materials (e.g., metals or plastics). By way of example, the sleeve spring captivator 64 is fabricated from aluminum.

Figure 3:
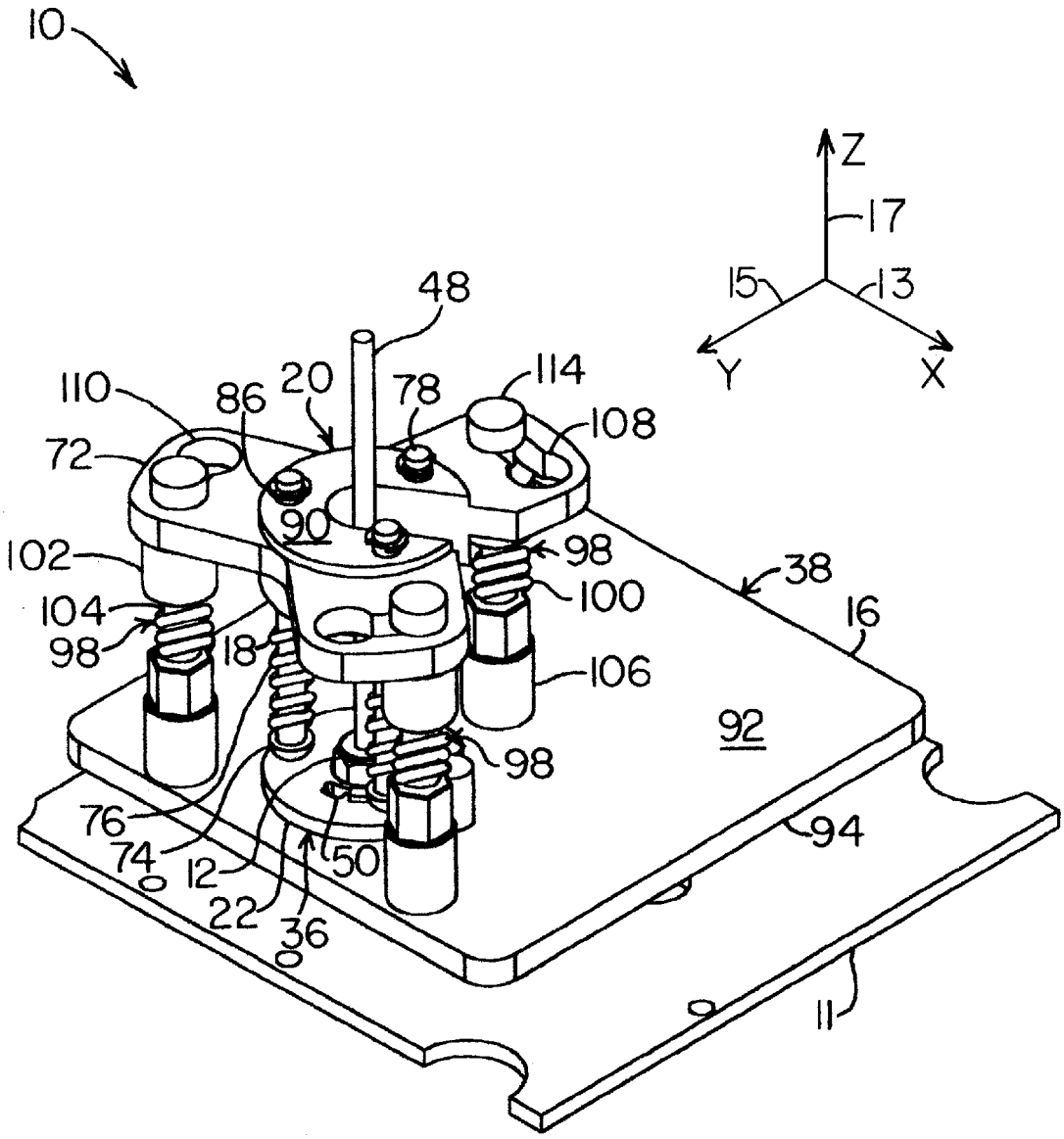
FIG. 3 is another perspective view of the connector alignment apparatus illustrated in FIG. 1.
Figure 5:
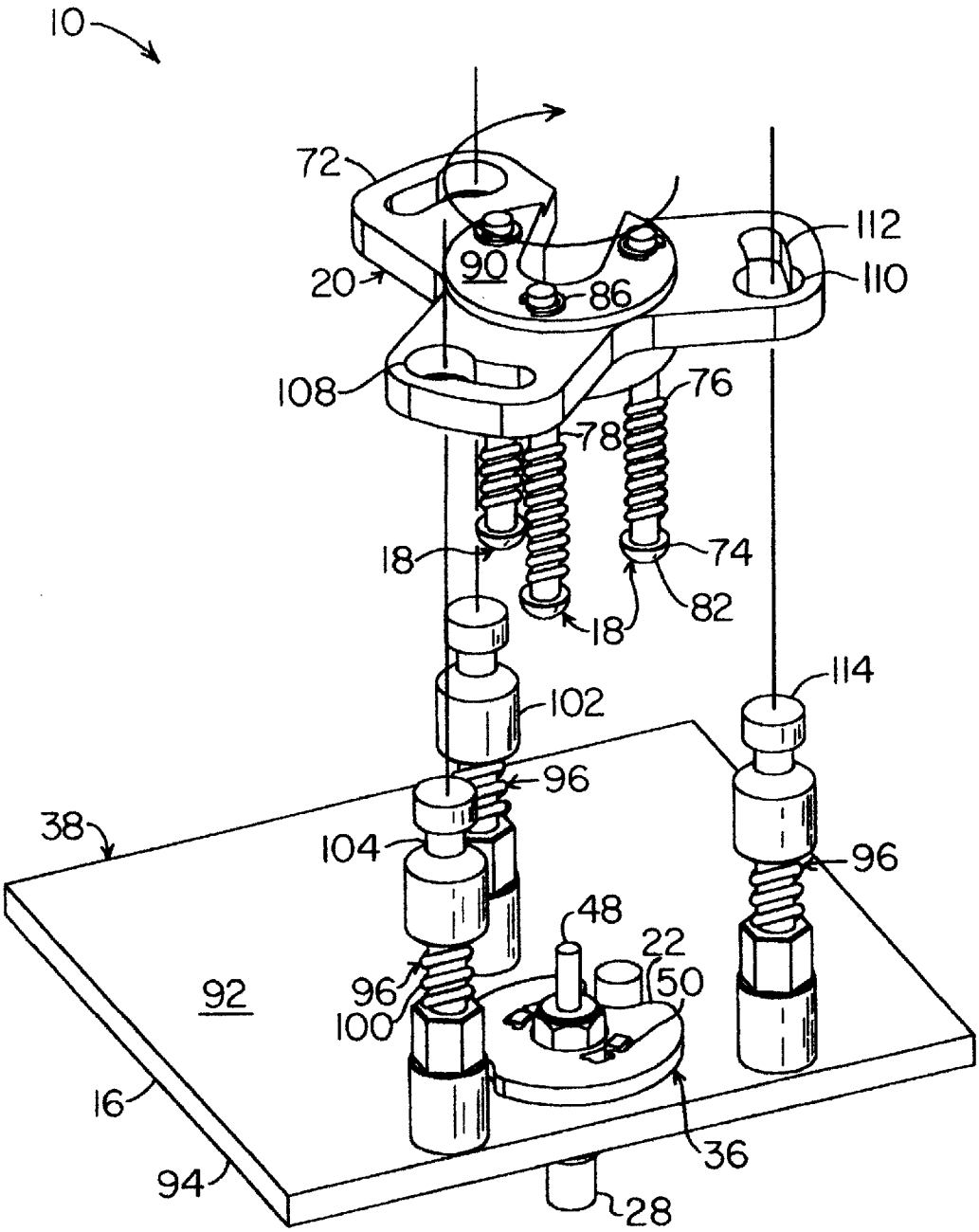
FIG. 5 is an exploded perspective view of the tripod spring assembly.

The tripod spring assembly 20 is best seen in FIGS. 3 and 5 and forms connector biasing device 18 which allows the connector assembly 36 to move or "float" with respect to the mounting plate 16. In the embodiment shown and described herein, the tripod spring assembly 20 comprises three spring plunger assemblies 74 which contact the alignment member 22 at three corresponding contact points (not shown). The three point support arrangement allows the tripod spring assembly 20 to floatingly support the connector assembly 36 within the mounting plate 16. However, a greater or lesser number of spring plunger assemblies 74 may be used depending on the particular application.

Each of the spring plunger assemblies 74 are essentially identical and may comprise a clamping rod 78 sized to slidably fit within holes 88 provided in the connector spring support structure 72. A ball end 82 may be provided on an end of each clamping rod 78. In the embodiment shown and described herein, the clamping rods 78 are mounted to the connector spring support structure 72 with retaining rings 86. More specifically, the clamping rods 78 are inserted into holes 88 defined by structure 72. The retaining rings 86 are then secured to the portions of the clamping rods 78 protruding through holes 88 above the top surface 90 of structure 72. This mounting arrangement allows the clamping rods 78 to move upwardly in the z-direction 17 relative to the mounting plate 16 (FIGS. 3 and 4) and to move downwardly back to their initial position with the retaining rings 86 resting on the top surface 90 of structure 72 (FIG. 1). Alternatively, other mounting arrangements could be used, as would be obvious to persons having ordinary skill in the art after having become familiar with the teachings of the present invention.

When mounting the spring plunger assemblies 74, it is generally preferred, but not required, that the spring plunger assemblies 74 be positioned in generally parallel, spaced-apart relation to one another and be positioned so that their ball ends or tips 82 are equidistant from each other. As best seen in FIG. 7, it is also desirable to have a spaced distance 84 separating the alignment member 22 and the tips 82 of spring plunger assemblies 74 when the connector alignment apparatus 10 is in an initial position, although such is not required. In the embodiment shown and described herein, the spaced distance 84 is approximately 0.20 millimeters when the connector alignment apparatus 10 is in its initial position.

Each spring plunger assembly 74 may further comprise a coil spring 76. The coil springs 76 bias the clamping rods 78 in an extended or downward position with respect to the connector spring support structure 72. Alternatively, other types of biasing devices could be used, as would be obvious to persons having ordinary skill in the art after having become familiar with the teachings of the present invention.

It is generally preferred that the spring coefficients of the coil springs 76 be greater than the spring coefficient of the sleeve spring 32. This allows the alignment sleeve 28 to be fully retracted within the sleeve spring captivator 64 before the coil springs on the connector biasing device 18 will begin to be compressed. This arrangement also helps to protect the connectors 12 and 14 from damage by allowing excess forces to be transferred to the coil springs 76. In the embodiment shown and described herein, the spaced distance 80 is approximately 1.50 millimeters when the connectors 12 and 14 are engaged.

The mounting assembly 38 comprises the mounting plate 16 and the support structure 96 for the tripod spring assembly 20. The mounting plate 16 may comprise a generally rectangularly shaped plate-like member having a top surface 92 and a bottom surface 94 positioned in generally parallel, spaced-apart relation. Alternatively, other shapes and configurations are possible.

The mounting plate 16 may define an aperture 26 therein. It is generally preferred, but not required, that the aperture 26 comprise a generally cylindrical shape and be sized to floatingly receive the connector assembly 36 in the manner already described. That is, the aperture 26 is sufficiently large so that the diametrical clearance 66 is defined between the sleeve spring captivator 64 and the cylindrical surface 68 that defines aperture 26. The diametrical clearance 66 allows the connector assembly 36 to move with respect to the mounting plate 16.

The mounting plate 16 may be fabricated from any of a wide range of suitable materials (e.g., plastics or metals). By way of example only, the mounting plate 16 is fabricated from metal.

The support structure 96 supports the tripod spring assembly 20. In the embodiment shown and described herein, the support structure 96 comprises three lifting or supporting spring members 98. However, a greater or lesser number of lifting spring members 98 may be used depending on the particular application. Consequently, the present invention should not be regarded as limited to the particular number of lifting spring members 98 shown and described herein.

The lifting spring members 98 are essentially identical and comprise a lifting or support spring 100, a lifting cone 102, and a shoulder screw 104 secured to the mounting plate 16. Each of the lifting cones 102 may comprise a generally cylindrical shape having a cone-shaped end sized to engage a hole 108 in connector spring support structure 72. The lifting springs 100 and the lifting cones 102 are both sized to slidably receive the shoulder screws 104. The lifting cones 102 are also sized to be positioned between the structure 72 of tripod spring assembly 20 and the lifting spring 100 so that the lifting cones 102 are biased upward with respect to the tripod spring assembly 20 by the lifting springs 100.

In the embodiment shown and described herein, the lifting springs 100 comprise coil springs. Although other types of biasing devices may be used, as would be obvious to persons having ordinary skill in the art after having become familiar with the teachings of the present invention. It is generally preferred, but not required, that the spring coefficient of the lifting springs 100 be large enough such that the lifting spring members 98 support the entire weight of the tripod spring assembly 20.

Each of the lifting spring members 98 may be mounted to the mounting plate 16 by any suitable fastening system or device, as would be obvious to persons having ordinary skill in the art after having become familiar with the teachings of the present invention. By way of example only, in the embodiment shown and described herein, each of the lifting spring members 98 are mounted to the mounting plate 16 by way of shoulder screws 104. More specifically, the shoulder screws 104 are first inserted through the lifting cones 102 and lifting springs 100 and then secured to mounting plate 16. However, if additional mounting plate thickness is required, the shoulder screws 104 may instead be mounted to standoffs 106 that are secured the mounting plate 16. As best seen in FIG. 1, the standoffs 106 comprise generally cylindrically shaped members that are mounted directly to the mounting plate 16. The standoffs 106 may be used, for example, if a technician wants to increase the effective thickness of the mounting plate 16. A possible reason for increasing the thickness is to raise the tripod spring assembly 20 and thereby increase the distance 84 separating the alignment member 22 and the tips 82 of spring plunger assemblies 74. Alternatively, the technician could instead select a thicker mounting plate, however, the technician would then be required to recreate the aperture 26 in the thicker plate.

The shoulder screws 104 may also be used to secure the connector spring support structure 72 to the lifting spring members 98. As best seen in FIG. 5, the connector spring support structure 72 may define three openings 108, each having a larger portion or starting chamfer 110 and a smaller portion or locking chamfer 112. The larger portions 110 may each be sized to receive a head 114 of a shoulder screw 104. The smaller portions 112 may be sized to receive the shoulder screws 104 but be sized such the heads 114 will not pass therethrough. By first lowering the connector spring support structure 72 until the heads 114 of shoulder screws 104 extend through the larger portions 110 of openings 108 and then rotating the structure 72 so that the heads 114 are positioned above the smaller portions 112 of openings 108, the structure 72 is secured to the lifting spring members 98 and prevented from moving upwardly during the test of the device under test.

The connector alignment apparatus 10 may be used as follows to align and electrically connect the mating connectors 12 and 14. Before operating the connector alignment apparatus 10, the three assemblies 20, 36 and 38 comprising the connector alignment apparatus 10 must be assembled. Although the assembly process for the connector assembly 36 will be discussed first, the three assemblies 20, 36 and 38 may actually be put together in any order.

Referring to FIG. 6, the connector assembly 36 comprises the sleeve spring captivator 64, alignment sleeve 28, sleeve spring 32, first connector 12, alignment member 22, SMP Cable Nut 44 and wave washer 46. To begin, the first connector 12 is mounted to the alignment member 22 by way of the SMP Cable Nut 44 and wave washer 46. Next, the alignment sleeve 28 and sleeve spring 32 are positioned within the central opening 70 of sleeve spring captivator 64. The sleeve spring captivator 64 is then slid over the first connector 12 so that the lower portion 30 of first connector 12 is positioned within the central opening 58 of alignment sleeve 28. Finally, the sleeve spring captivator 64 is mounted to the alignment member 22.

Referring back to FIG. 5, the tripod spring assembly 20 comprises the three spring plunger assemblies 74, three retaining rings 86 and connector spring support structure 72. First, each of the three spring plunger assemblies 74 are inserted into a corresponding one of the three holes 88 defined by structure 72. As described earlier, the retaining rings 86 are then used to movably secure each of the spring plunger assemblies 74 within the corresponding one of the holes 88.

Still referring to FIG. 5, the mounting assembly 38 comprises the mounting plate 16 and three lifting spring members 98. To assemble the mounting assembly 38, the optional standoffs 106 may be mounted to the mounting plate 16. The shoulder screws are next inserted through the lifting cones 102 and lifting springs 100 and then secured either directly to the mounting plate 16 or to the optional standoffs 106.

To complete the connector alignment apparatus 10, the connector assembly 36 is inserted into the aperture 26 defined by mounting plate 16. The tripod spring assembly 20 is lowered so that the heads 114 of shoulder screws 104 extend through the larger portions 110 of openings 108. The tripod spring assembly 20 is then rotated so that the heads 114 are positioned above the smaller portions 112 of openings 108 which secures the tripod spring assembly 20 to the lifting spring members 98 and prevents it from moving upwardly during the test of the device under test.

Once the connector alignment apparatus 10 has been properly assembled, the printed circuit board 11 is positioned underneath the connector alignment apparatus 10. Any of a wide range of devices and systems may be used to position the printed circuit board 11 underneath the connector alignment apparatus 10. Once the printed circuit board 11 and connector alignment apparatus 10 have been aligned, the two devices are then brought together, either by moving the printed circuit board 11 toward the connector alignment apparatus 10, by moving the connector alignment apparatus 10 toward the printed circuit board 11, or by some combination of the two. By way of example, in one preferred embodiment, the printed circuit board 11 is moved toward the connector alignment apparatus 10 by elevating or raising the printed circuit board 11 while maintaining the connector alignment apparatus 10 in a fixed or stationary position. As the printed circuit board 11 is being raised, the alignment sleeve 28 first engages or captures the mating connector 14, thereby initially aligning the connector portions 12 and 14. Any misalignment between the connectors will be compensated by the floating mounting arrangement of the alignment member 22. That is, the alignment sleeve 28 will provide a side force to the alignment member 22 causing it to move in the x-y plane until the connector 12 is substantially aligned with the connector 14. As the printed circuit board 11 continues to rise, the mating connector 14 begins to engage the first connector 12. After the connectors 12 and 14 have been fully engaged, continued movement of the printed circuit board 11 toward the connector alignment apparatus 10 causes the alignment sleeve 28 to move upward with respect to the connector portion 12, compressing the sleeve spring 32. In the embodiment shown and described herein, this movement of the alignment sleeve 28 occurs during about the last ⅓ of desired travel. After the alignment sleeve 28 is fully retracted, any continuing movement of the printed circuit board 11 toward the connector alignment apparatus 10 results in the upward movement of the connector 12 and alignment plate 22 with respect to the mounting plate 16. Eventually, the upward movement will compress the connector biasing device 18, as is best seen in FIG. 4. The printed circuit board 11 may then be tested in accordance with testing procedures developed for the particular situation.

Once testing of the printed circuit board 11 is complete, the devices may be separated, e.g., by lowering the printed circuit board 11. As the printed circuit board 11 is lowered, the downward spring bias of alignment sleeve 28 assists in the disengagement of the connectors 12 and 14. Continued lowering of the printed circuit board 11 causes the connector biasing device 18 to decompress until the alignment member 22 returns to the initial position illustrated in FIG. 7. The printed circuit board 11 may then be carried away and the next printed circuit board (not shown) moved into position. The testing process may then be repeated.

It is contemplated that the inventive concepts herein described may be variously otherwise embodied and it is intended that the appended claims be construed to include alternative embodiments of the invention except insofar as limited by the prior art.

What is claimed is:

1. Connector alignment apparatus, comprising:

a mounting plate;

a first connector sized to engage a mating connector;

a connector biasing device operatively associated with said mounting plate and said first connector, said connector biasing device allowing said first connector to move with respect to said mounting plate as said first connector is engaged with said mating connector; and an alignment member mounted to said first connector, said alignment member being operatively associated with said connector biasing device, said connector biasing device allowing said alignment member to move with respect to said mounting plate, said connector biasing device comprising three contact points positioned to contact said alignment member, said connector biasing device also comprising three springs.

2. Connector alignment apparatus, comprising:

a mounting plate;

a first connector sized to engage a mating connector;

a connector biasing device operatively associated with said mounting plate and said first connector, said connector biasing device allowing said first connector to move with respect to said mounting plate as said first connector is engaged with said mating connector; and an alignment member mounted to said first connector, said alignment member being operatively associated with said connector biasing device, said connector biasing device allowing said alignment member to move with respect to said mounting plate, wherein said connector biasing device and said alignment member are separated by a spaced distance when said connector alignment apparatus is in an initial position.

3. Connector alignment apparatus, comprising:

a mounting plate;

a first connector sized to engage a mating connector;

a connector biasing device operatively associated with said mounting plate and said first connector, said connector biasing device allowing said first connector to move with respect to said mounting plate as said first connector is engaged with said mating connector;

an alignment member mounted to said first connector, said alignment member being operatively associated with said connector biasing device, said connector biasing device allowing said alignment member to move with respect to said mounting plate;

an alignment sleeve having a central opening therein sized to receive said first connector, said alignment sleeve also being sized to engage a portion of said mating connector; and a sleeve biasing device operatively associated with said alignment sleeve and said alignment member, said sleeve biasing device biasing said alignment sleeve toward an extended position.

4. Connector alignment apparatus, comprising:

a mounting plate;

a first connector sized to engage a mating connector;

a connector biasing device operatively associated with said mounting plate and said first connector, said connector biasing device allowing said first connector to move with respect to said mounting plate as said first connector is engaged with said mating connector;

an alignment member mounted to said first connector, said alignment member being operatively associated with said connector biasing device, said connector biasing device allowing said alignment member to move with respect to said mounting plate;

a connector spring support structure operatively associated with said connector biasing device; and a support structure biasing device operatively associated with said connector spring support structure, said support structure biasing device supporting a portion of the weight of said connector spring support structure.

5. The connector alignment apparatus of claim 4, wherein said support structure biasing device is mounted to said mounting plate.

6. The connector alignment apparatus of claim 4, wherein said support structure biasing device comprises three springs.

7. Connector alignment apparatus, comprising:

a mounting plate defining an aperture therein;

an alignment member sized to floatingly fit in said aperture;

a first connector mounted to said alignment member, said first connector being sized to engage a mating connector;

an alignment sleeve having a central opening therein sized to receive said first connector, said alignment sleeve also being sized to engage a portion of said mating connector;

a sleeve spring operatively associated with said alignment sleeve and said alignment member, said sleeve spring biasing said alignment sleeve toward an extended position and allowing said alignment sleeve to move with respect to said alignment member;

a sleeve spring captivator mounted to said alignment member, said sleeve spring captivator defining a central opening therein sized to receive said alignment sleeve and said sleeve spring, said alignment sleeve being movably positioned within the central opening defined by said sleeve spring captivator, said sleeve spring being positioned within the central opening defined by said sleeve spring captivator; and three connector springs operatively associated with said alignment member and said mounting plate, said three connector springs allowing said alignment member to move with respect to said mounting plate as said first connector is engaged with said mating connector.

8. The connector alignment apparatus of claim 7, wherein said alignment member and said mounting plate are separated by a spaced distance when said first connector is engaged with said mating connector.

9. The connector alignment apparatus of claim 7, wherein said three connectors springs and said alignment member are separated by a spaced distance when said connector alignment apparatus is in an initial position.

10. The connector alignment apparatus of claim 7, further comprising a connector spring support structure, and wherein said three connector springs are mounted to said connector spring support structure.

11. The connector alignment apparatus of claim 10, further comprising three support springs operatively associated with said connector spring support structure, said three support springs supporting a portion of the weight of said connector spring support structure and said three connector springs.

12. The connector alignment apparatus of claim 11, wherein said three support springs are mounted to said mounting plate.

* * * * *